US005470059A

United States Patent [19]

Largent

[11] Patent Number: 5,470,059

[45] Date of Patent: Nov. 28, 1995

[54] SOFT SPHERICAL PLAYING BALL AND METHOD OF MAKING SAME

[76] Inventor: Gerald A. Largent, 20573 Belvidere Ave., Fairview Park, Ohio 44126

[21] Appl. No.: 374,129

[22] Filed: Jan. 18, 1995

[51] Int. Cl.[6] ..... A63B 37/02; A63B 37/12

[52] U.S. Cl. ..... 273/60 B; 29/899

[58] Field of Search ..... 29/899, 899.1; 273/58 A, 60 B, 60 A, 60 R, 58 K, 26 R

[56] References Cited

U.S. PATENT DOCUMENTS 1,458,776 6/1923 Nye ..... 273/60 B 4,065,126 12/1977 Mantz ..... 273/58 A 5,253,865 10/1993 Konnee ..... 273/28 A X

*Primary Examiner*—George J. Marlo

[57] ABSTRACT

The invention pertains to a soft spherical playing ball consisting of a pair of yarn type socks rolled together to form a spherical ball simulating a baseball. The first sock is rolled into a cylindrical core and then rolled end over end in the second sock to form a spherical core where the ribbed open end of the second sock is opened inside out and pulled backward over the spherical core to provide a cover for the playing ball. The open ribbed end of the second sock is positioned on the spherical core to partially expose opposed ends of the spherical core defined by a first seam and second seam to assimulate the seams of a baseball.

9 Claims, 4 Drawing Sheets

SOFT SPHERICAL PLAYING BALL AND METHOD OF MAKING SAME

This invention pertains to a soft athletic playing ball fabricated from a pair of ordinary tubular socks rolled together in an unconventional manner to produce a soft playing ball useful indoors and elsewhere.

BACKGROUND OF THE INVENTION

Students frequently create athletic games that can be played indoors where a soft playing ball is used to assimilate the characteristics of a baseball. In dormitories for instance, a soft playing ball is required because of close quarters and the desire to avoid damage to the surroundings while still engaging in a spirited game. Soft athletic playing balls are known for example in U.S. Pat. No. 4,257,598 where the ball comprises a rolled up piece of cloth and/or yarn held together by adhesive tape and disposed within a cover. Such soft core balls can be thrown or hit by youngsters as a real ball but avoids injuries as well as damage indoors to fragile and breakable furniture and windows. Other game balls are known such as shown in U.S. Pat. No. 3,976,295 and U.S. Pat. No. 4,149,720, but these balls contain preformed foam and rubber or elastomeric cores.

It now has been found that a pair of ordinary yarn fabricated tube socks made from cotton and/or polyester or similar flexible yarn can be rolled together with little effort to produce a soft athletic ball resembling a baseball. In accordance with this invention, a first tube sock is stretched lengthwise and then rolled into a cylindrical shaped core. The rolled cylindrical core is then located on the toe section of the second stretched sock which is progressively rolled from toe to the ribbed end to form a spherical core. The ribbed open end of the second sock is slipped backwards and stretched over the spherical core to completely surround and enclose the sperical core. The ribbed end section of the second sock is then slipped backwards over the spherical core to form the outer cover of the playing ball. The outer cover can be arranged to partially expose a small portion of opposite ends of the spherical core defined by a first seam and a second seam to assimilate the sewn seams of a baseball. In this manner, a soft harmless playing ball can be fabricated in a matter of a few minutes from a pair of ordinary wearing apparrel socks. The advantages of the invention will become more apparent by referring to the drawings and detailed description of the invention.

SUMMARY OF THE INVENTION

Briefly, the invention pertains to a soft playing ball produced from a pair of stretch yarn type socks where the first sock is rolled into core under tension to form a cylindrical core and rolled into the second sock under tension. The first and second socks combined form a spherical core and an outside cover of the playing ball. The open rib end of the second sock is first pulled over the spherical core and then pulled backward and inside out to expose a small portion of the sperical core and form a first seam. The distal rib end is pulled partially over the spherical core to form a second seam where the two seams assimilate the seams of a baseball.

Figure 13A:
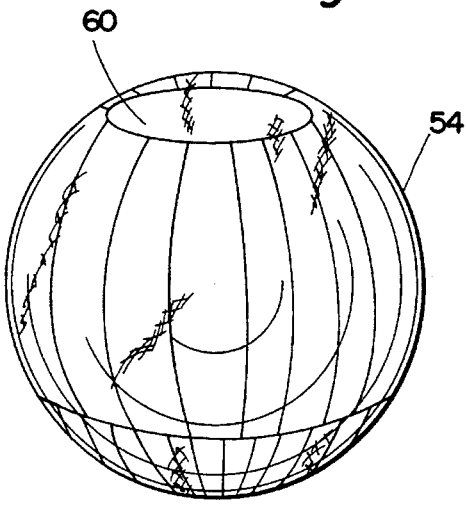
Figure 14:
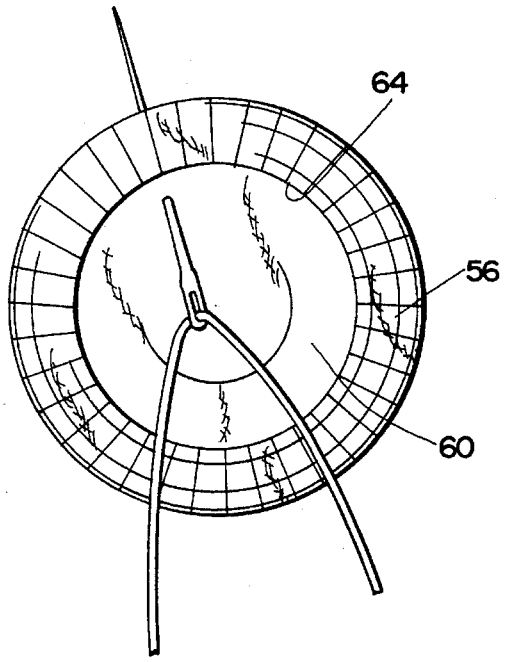
Figure 15:
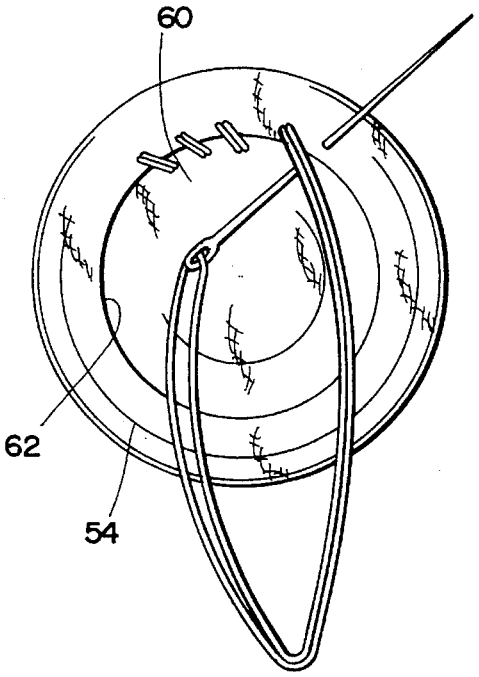
Figure 16:
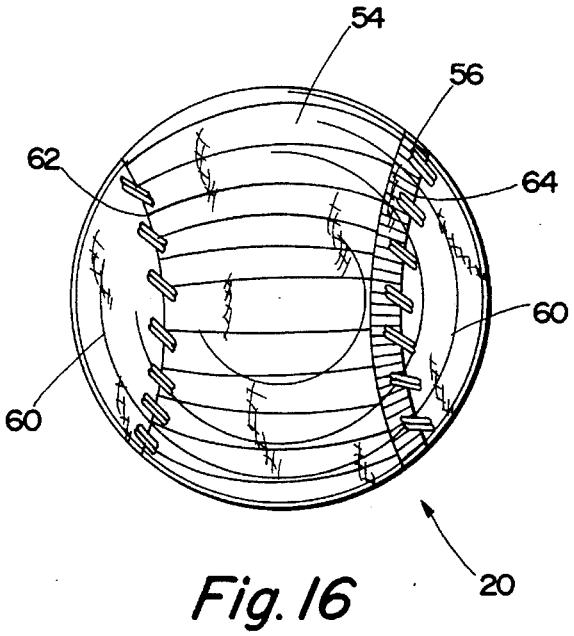

FIG. **13*a*** is a perspective view of the playing ball of this invention with the rib end of the second sock pulled backward over the spherical core and leaving an exposed end portion of the spherical core;

FIG. **13*b* is a perspective view of the playing ball similar to FIG. 13*a*** but rotated to show exposed opposite ends of the spherically formed core;

FIG. 14 is a side elevation view of the playing ball as viewed from the left in FIG. **13*b*** and showing the distal ribbed end being stitched into a first seam with an exposed end portion of the spherical core;

FIG. 15 is a side elevation view of the playing ball as viewed from the right in FIG. **13*b* end showing an exposed end portion of the spherical core being stitched into a second seam; and FIG. 16** is a perspective view of the playing ball of this invention with two stitched seams.

DESCRIPTION OF THE PREFERRED EMBODIMENT

Referring now to the drawings where like reference characters indicate like parts, shown in FIG. 16 is the playing ball 20 of this invention comprising a first sock 30 rolled in a second sock 50 in accordance with the procedures illustrated in FIGS. 1–5 inclusive.

Figure 1:
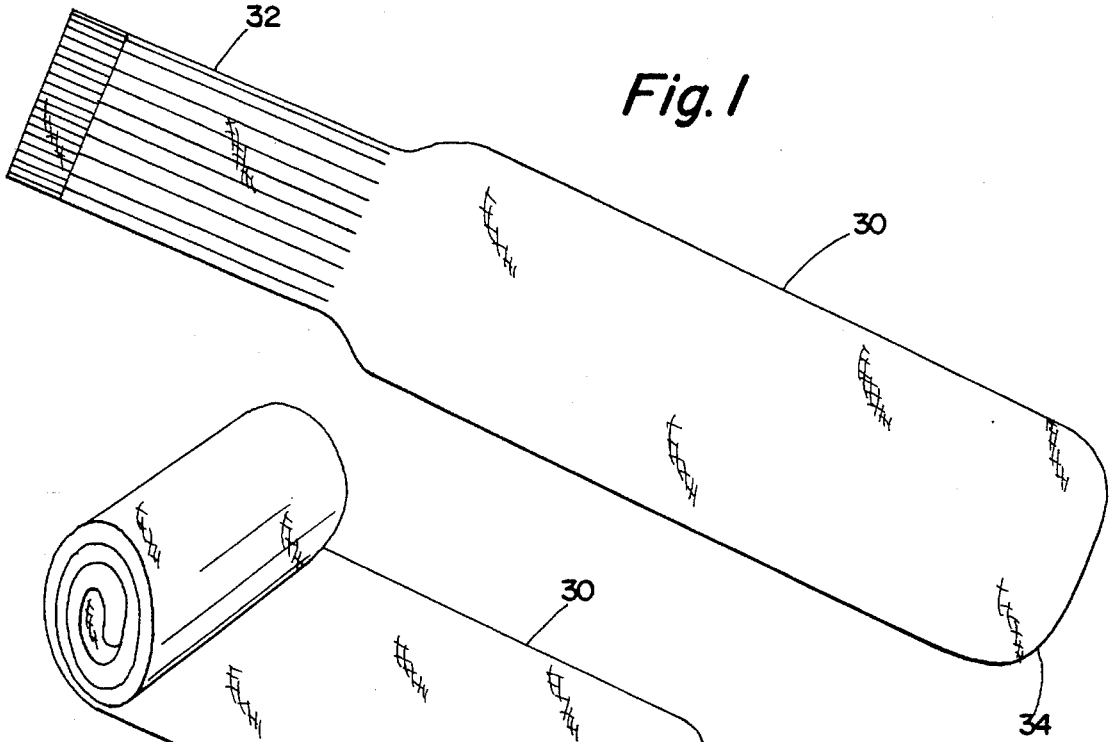
FIG. 1 is a plan view of a first stretch sock.
Figure 2:
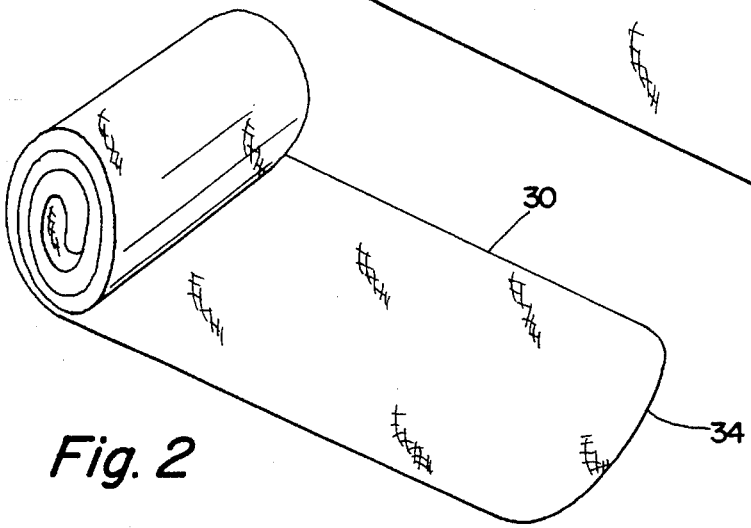
FIG. 2 is a perspective view of the first sock being rolled linearly into a cylinder.
Figure 3:
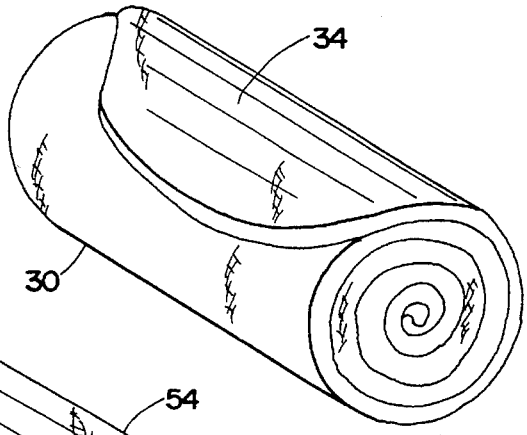
FIG. 3 is a perspective view of the first sock rolled into a cylindrical core.
Figure 4:
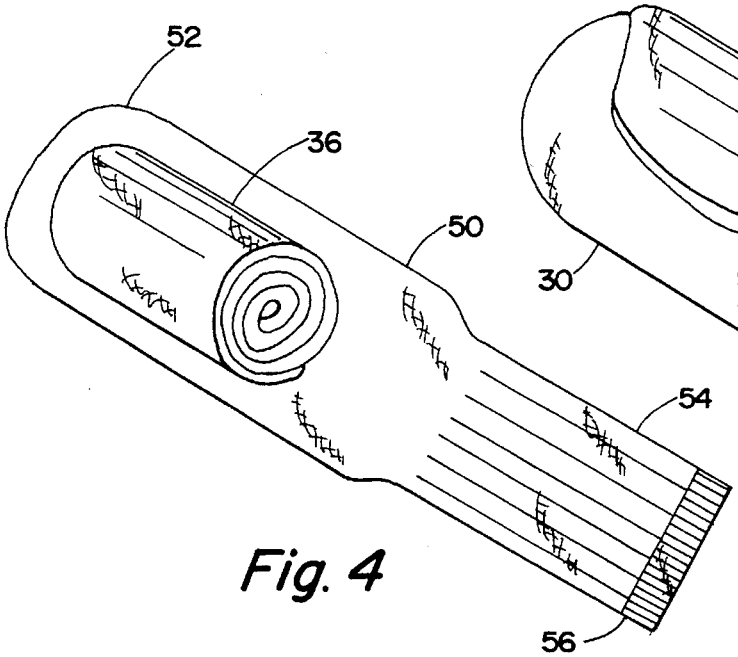
FIG. 4 is a perspective view showing the cylindrical core of FIG. 3 disposed on top of a second stretch sock.
Figure 5:
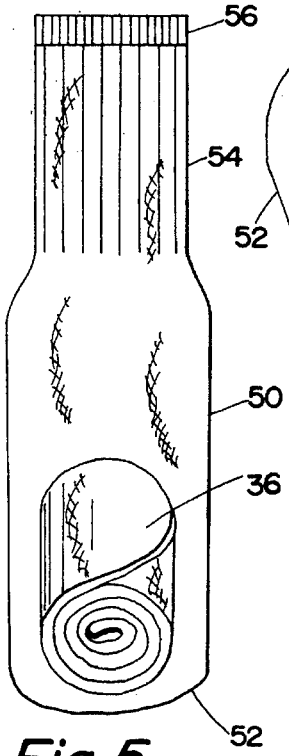
FIG. 5 is a perspective view showing an alternative placement of the cylindrical core similar to FIG. 4.
Figure 6:
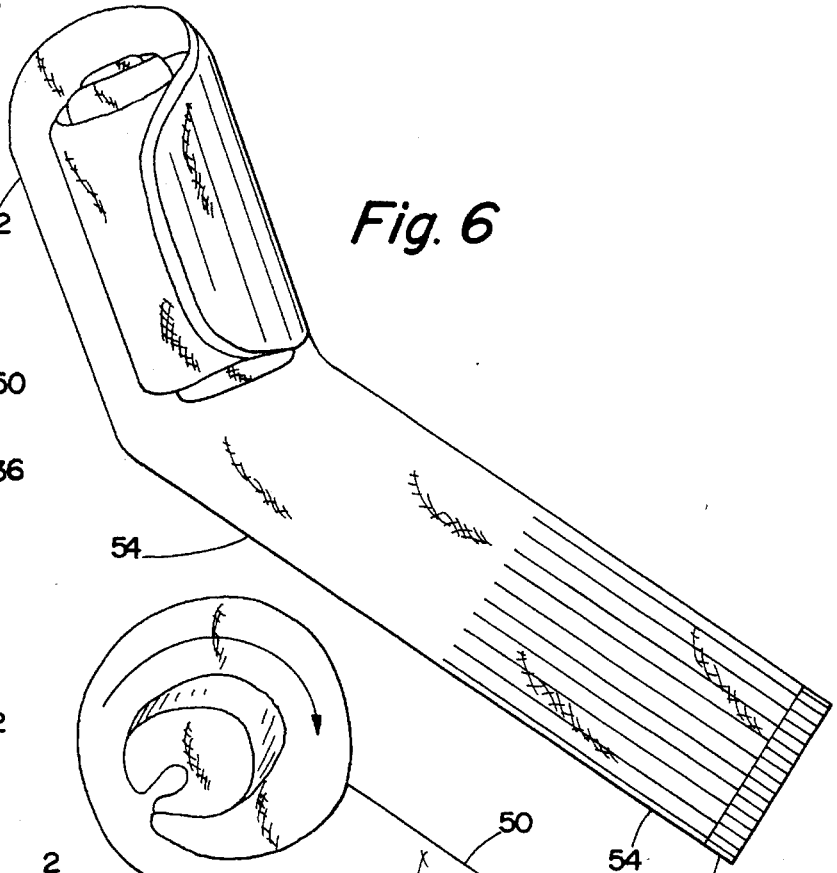
FIG. 6 is a perspective view showing the cylindrical core disposed on the top portion of a stretched second sock.
Figure 7:
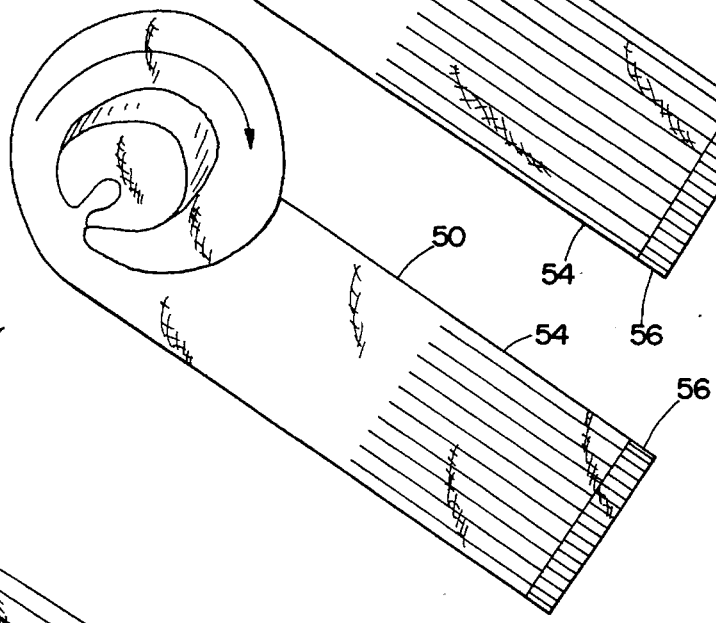
FIG. 7 is a perspective view of the cylindrical core being rolled into the second sock.
Figure 8:
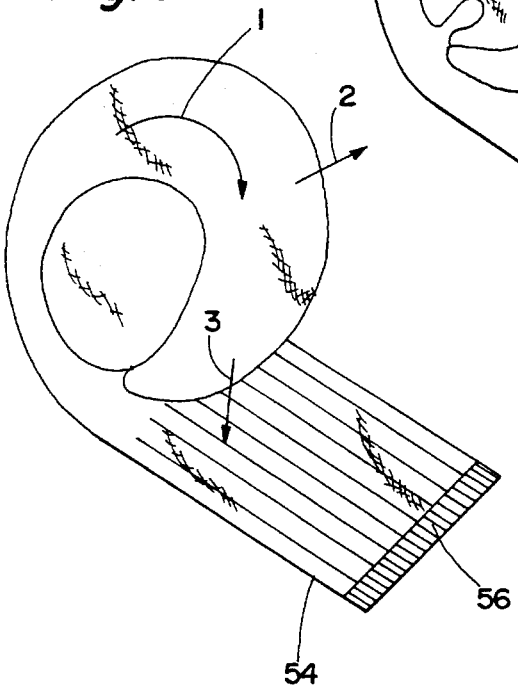
FIG. 8 is a perspective view showing the spherical formation of the core in the second sock.

As shown in FIGS. 1, 2 and 3, the first sock 30 having a rib end 32 and an opposite toe end 34 is first stretched flat while applying pressure to the toe end 34. The rib end 32 is then rolled cylindrically with rib end 32 disposed internally and the toe end 34 disposed externally to form a cylindrical core 36 shown in FIG. 3. The cylindrical core 36 comprising the rolled up first sock 30 is disposed linearly on the second sock 50 near the toe end 52 where the cylindrical core 36 is aligned linearly with the toe 52 and opposite ribbed end 54 is stretched the length or,the second sock 50 as shown in FIGS. 4, 5, and 6. The cylindrical core 36 has circular ends and is rolled end over end first within the section 52 of the second sock 50 as shown in FIGS. 7 and 8. While rolling the second sock toward the rib end 54 the laterally spaced linear edges of the second sock 50 are simultaneously stretched transversely or laterally over the outer periphery of the cylindrical core 36, as shown in FIG. 8, to form a composite spherical core 60 shown in FIG. 10 comprising the cylindrical core 36 rolled within the second sock 50. For best results, the second sock 50 is maintained taut or stretched during the rolling process.

Figure 9:
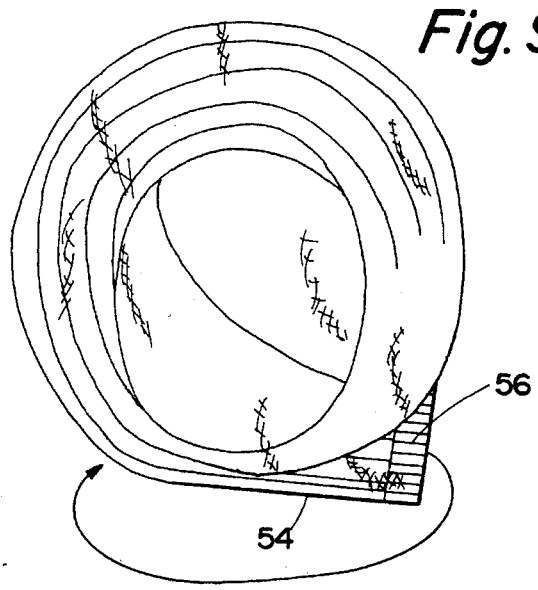
FIG. 9 is a perspective view of the formation step of the spherically formed core.
Figure 10:
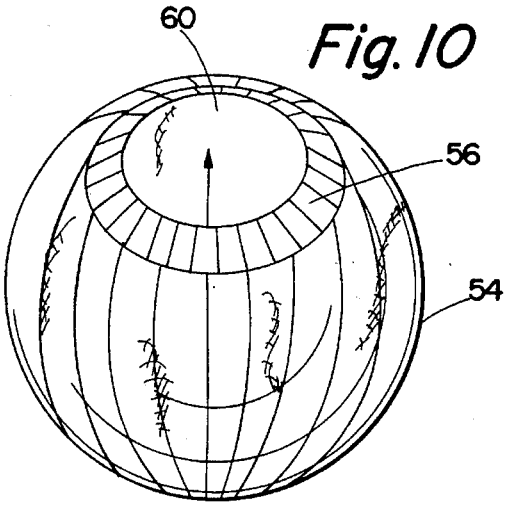
FIG. 10 is a perspective view of the intermediate formation step of the spherically formed core.
Figure 11:
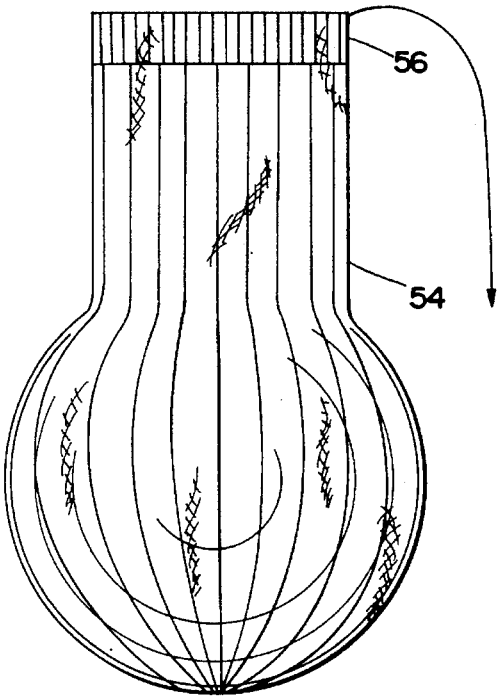
FIG. 11 is a perspective view of the spherical core completely enclosed within the second sock.
Figure 12:
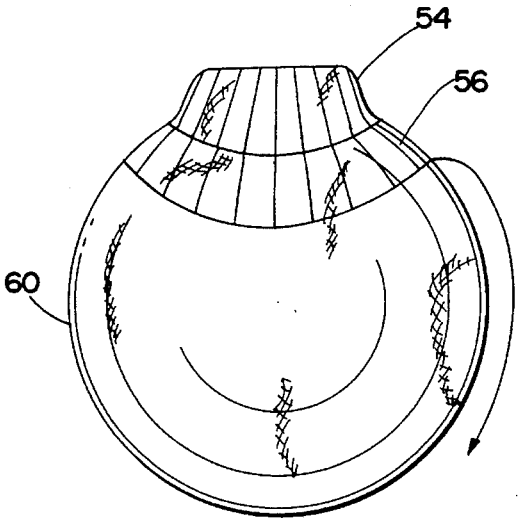
FIG. 12 is a perspective view of the rib end of the second sock being pulled backwards over the spherical core.
Figure 13B:
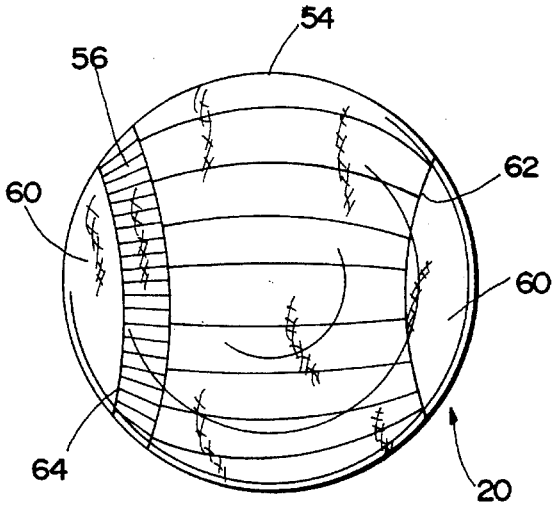

To form the spherical shape shown in FIG. 10, the rib end 54 is pulled backwards over the spherical core 60, as shown in FIG. 9, while the rib end 56 is opened, expanded and pulled backwards inside out to surround and enclose the spherically formed core 60. The inside out rib section 54 is then pulled completely over the spherical core 60 and extended upwardly beyond the internal spherical core as shown in FIG. 11. The ribbed end 56 of the second sock 50 is again reversed and pulled downwardly over the internal spherical core 60 as progressively shown by arrows in FIGS. 11 and 12 to leave a small top end portion of the spherical core 60 exposed as shown in 13*a*. The ribbed end 54 forms the outside cover of the ball 20 while the distal rib end 56 of the second sock 50 is located toward the opposite end but leaving an exposed spherical core portion 60 as shown in FIG. 13*b*. Thus, the playing ball 20 comprises two spherical exposed ends of spherical core 60 contained within the ribbed section 54 of the second sock forming a first seam 62 and a second seam 64 with spherical core 60. First seam 62 of rib section 54 can be stitched to the spherical core 60 as shown in FIG. 15 while the second seam 64 adjacent to the distal rib end 56 can be stitched to spherical core 60 at the opposite end of the playing ball 20. The finished stitched playing ball of this invention is shown in FIG. 16.

Although preferred embodiments of the invention are described and illustrated in the drawings, the invention is not intended to be limited except by the appended claims.

What I claim:

1. A soft playing ball consisting of two flexible tubular socks rolled together to form a spherical ball the playing ball comprising:

a first sock rolled into a cylindrical core, the cylindrical core rolled within a second sock having a toe end and an opposite open ribbed end providing an opening to the interior of the second sock, the cylindrical core having circular ends linearly aligned with the toe end and ribbed end of the second sock, the first sock rolled end over end from the toe end of the second sock to the ribbed end of the second sock to form a spherical core, the ribbed end of the second sock opened and stretched backwards over the spherical core to enclose the spherical core, where the ribbed end is reverse folded to leave an exposed portion of the spherical core defined by a first seam, and the ribbed end partially enclosing the spherical core and leaving the opposite end of the spherical core exposed and defined by a second seam.

2. The playing ball of claim 1 where the first seam and the second seam are each individually stitched to the spherical core.

3. The playing ball of claim 1 where the second sock has laterally spaced edges extending linearly from the toe end to the ribbed end, and the spherical core is formed by stretching the linear edges of the second sock to overlap the cylindrical core while rolling the cylindrical core end over end in the second sock.

4. The playing ball of claim 1 where the first and second socks are stretch yarn tube socks.

5. The playing ball in claim 1 where the cylindrical core consists of the first sock having a toe end and a rib end, where the cylindrical core contains the ribbed end of the first sock rolled internally and the toe end of the first sock rolled externally to form the cylindrical core.

6. A method of producing a soft playing ball by rolling two flexible tubular socks together, the method comprising:

rolling a first sock into a cylindrical core having opposite circular ends;

aligning a second sock linearly where the second sock has a toe end an opposite open ribbed end, and the toe end is aligned with the ribbed end;

locating the cylindrical core on the toe end of the second sock the circular ends of the cylindrical core aligned linearly with the toe end and the ribbed end of the second sock;

rolling the cylindrical core end over end in the second sock by rolling from the toe end to the ribbed end of the second sock to form a spherical core;

opening the ribbed end of the second sock and pulling the ribbed end backwards over the spherical core to surround and enclose the spherical core;

reversing the open ribbed end of the second sock to leave an exposed portion of the spherical core defined by a first seam; and positioning the distal end of the ribbed end of the second sock to leave an opposite exposed end of the spherical core defined by a second seam.

7. The method of claim 6 where the first seam and the second seam are each stitched separately to the spherical core.

8. The method of claim 6 where the cylindrical core is formed by stretching the first sock linearly having a toe end and an opposite rib end disposed linearly, and then rolling the ribbed end of the first sock internally with the toe end of the first sock rolled externally.

9. The method of claim 6 where the second sock has laterally spaced edge extending linearly from the toe end to the ribbed end of the second sock, and the linear edges are stretched laterally to overlap the cylindrical core while rolling the cylindrical core end over end in the second sock.

* * * * *